US006718956B2

(12) United States Patent
Klipfel et al.

(10) Patent No.: US 6,718,956 B2
(45) Date of Patent: Apr. 13, 2004

(54) COOLER OF AN EXHAUST GAS RECIRCULATION SYSTEM AND EXHAUST GAS RECIRCULATION SYSTEM INCLUDING ONE SUCH COOLER

(75) Inventors: Bernhard Klipfel, Karlsruhe (DE); Ralf Hördt, Hembsbach (DE)

(73) Assignee: Cooper-Standard Automotive (Deutschland) GmbH, Hemsbach (DE)

( * ) Notice: Subject to any disclaimer, the term of this patent is extended or adjusted under 35 U.S.C. 154(b) by 0 days.

(21) Appl. No.: 09/969,525

(22) Filed: Oct. 2, 2001

(65) Prior Publication Data

US 2003/0015184 A1 Jan. 23, 2003

(30) Foreign Application Priority Data

Jul. 18, 2001 (EP) ..... 01116718

(51) Int. Cl.[7] ..... F02M 25/07
(52) U.S. Cl. ..... 123/568.12; 165/297
(58) Field of Search ..... 123/568.12; 60/605.2; 165/51, 103, 297

(56) References Cited

U.S. PATENT DOCUMENTS

| | | | | | |
|---|---|---|---|---|---|
| 2,076,287 | A | * | 4/1937 | Arnold | 237/12.3 B |
| 3,696,636 | A | * | 10/1972 | Mille | 62/399 |
| 4,498,524 | A | * | 2/1985 | Jacobsen | 165/103 X |
| 4,993,367 | A | * | 2/1991 | Kehrer | 122/7 R |
| 5,732,688 | A | * | 3/1998 | Charlton et al. | 123/568.12 |
| 6,330,910 | B1 | * | 12/2001 | Bennett | 165/297 |

FOREIGN PATENT DOCUMENTS

| | | | | |
|---|---|---|---|---|
| DE | 4430648 | * | 3/1996 | F28D/7/00 |
| DE | 197 33 964 A1 | | 2/1999 | |
| JP | 2000-291455 | * | 10/2000 | F02D/19/02 |

* cited by examiner

*Primary Examiner*—Tony M. Argenbright
(74) *Attorney, Agent, or Firm*—Fitch, Even, Tabin & Flannery

(57) ABSTRACT

A cooler of an exhaust gas recirculating system comprises a housing including coolant inflow and outflow ports and at least one bypass pipe arranged within said housing.

8 Claims, 1 Drawing Sheet

COOLER OF AN EXHAUST GAS RECIRCULATION SYSTEM AND EXHAUST GAS RECIRCULATION SYSTEM INCLUDING ONE SUCH COOLER

BACKGROUND OF THE DESCRIPTION

1. Field of the Invention

The present invention relates to a cooler of an exhaust gas recirculating system, as well as to an exhaust gas recirculating system including one such cooler.

Partly recirculating the exhaust gas to the fresh air end of the engine has been known in engine design for a long time as a means of reducing noxious emissions. Whilst this makes it necessary to cool the exhaust gas as a function of the operating condition of the engine, it is especially at low engine temperatures and/or low engine loading that cooling the exhaust gas may be undesirable. This is why, for this purpose a bypass is usually provided to bypass the cooler, the extent of the exhaust gas flow through the bypass or cooler being regulated by a suitable valve means.

2. Prior Art

A cooler is known from DE 197 33 964 A1. This cooler comprises a housing including coolant inflow and outflow ports. Furthermore provided is a bypass pipe which bypasses the cooler such that the recirculated exhaust gas flows at least in part through the bypass pipe and is not cooled.

SUMMARY OF THE INVENTION

The invention is based on the object of providing a cooler of an exhaust gas recirculating system as well as an exhaust gas recirculating system equipped with such a cooler for a simplified system and cooler structure.

In accordance therewith it is provided for that the bypass pipe arranged within the housing is now integrated to a certain extent in the housing of the cooler, i.e. running therein. In other words, the housing of the cooler comprising coolant inflow and outflow, more particularly the so-called shell of the cooler, forms the outer envelope of the cooler. Only the coolant inflow and outflow ports in the region of the cooler are provided outside of the housing, but not the bypass pipe which is instead integrated in the housing or shell. This substantially simplifies the structure of the cooler, resulting in the cooler being designed less complex. More particularly, the cooler now has a pleasing compact configuration with its surroundings uncluttered by additional piping, such as, for example, the bypass pipe formerly provided separately therefrom.

Tests have indicated that the wanted effect, namely practically avoiding cooling of the exhaust gas flowing through the bypass pipe, can already be achieved by configuring the bypass pipe significantly different than the cooling pipes. Although due to integratation in the shell of the cooler, within which the coolant, for example water, is located, achieves a certain cooling of the bypass pipe and its flow, this cooling effect may be maintained relatively slight by providing a single bypass pipe with a sufficient cross-section as extending substantially straight through the cooler. Contrary thereto, the portion through which the exhaust gas flows for the purpose of cooling can be configured so that it comprises a plurality of branched and correspondingly smaller pipes surrounded by a flow of coolant to achieve the desirable cooling effect. In accordance therewith, the cooling pipes, as compared to the bypass pipe, can be extended, for example by configuring them coiled. Now, when the exhaust gas flows through the cooling pipes, adequate cooling is achievable, whilst when the flow passes through the bypass pipe, even though this is located within the cooler shell, the cooling effect is substantially eliminated.

Preferred embodiments of the invention are set forth in the further claims.

It is good practice generally to configure the bypass pipe thermally insulated so that the cooling experienced by the bypass pipe is relatively slight. One particularly preferred embodiment is formed by the bypass pipe being provided as a double-walled pipe, the cavity between the two walls producing the desired insulating effect.

In this arrangement particularly good results have been achieved by forming a vacuum between the two walls of a double-walled pipe to eliminate, in particularly, the convection effect of a medium located between the two walls of the pipe. Furthermore, this embodiment lends itself particularly well to an advantageous method of producing the cooler in accordance with the invention, by the bypass pipe and preferably the complete cooler being produced by vacuum brazing. In this procedure the solder "traps" the vacuum between the two walls of a double-walled bypass pipe to thus enable, with no extra complication in production, a substantially insulated bypass pipe to be fabricated, suitable for integrating in the housing of the cooler in accordance with the invention whilst substantially preventing cooling of the exhaust gas flowing through the bypass pipe when in use.

As regards the exhaust gas inflow and outflow ports of the cooler in accordance with the invention, it is basically conceivable that the cooler features separate inflow and outflow ports at at least one end. In this case the exhaust gas flow would be branched off already prior to attaining the cooler, and depending on the setting of an actuator the exhaust gas would then attain the inflow of the cooling pipes or bypass of the cooler before being subjected to cooling or not. In this case a single outflow could be provided at the downstream end of the cooler since the porting as described could still join within the cooler. As an alternative it is, of course, just as conceivable that two outflows are provided, the flow paths then joining downstream of the cooler. Furthermore, an actuator may be provided at the downstream end of the cooler. In this case the upstream end of the cooler could feature one or two inflows, depending on whether the exhaust gas flow has already been branched or not upstream of the cooler. In any case, in this embodiment is can also be assured by an actuator at the end of the cooler that the closed off flow path is in all cases filled with exhaust gas, but not with a throughflow so that, for example, should the bypass pipe be closed off at the end thereof, the cooling pipes receive the throughflow in achieving cooling of the exhaust gas. Irrespective of the conceivable embodiments as described it is currently preferred in the scope of the invention that the cooler comprises at least one single inflow and preferably, in accordance therewith, a single outflow. To separate the flow paths, i.e. the bypass pipe, on the one hand, and the cooling pipes, on the other, an actuator is integrated to advantage in the cooler which serves to close off at least the bypass pipe. It is to be noted that the actuator may be provided basically so that it closes off optionally the bypass pipe or the cooling pipes or the common inflow of several cooling pipes. Tests have indicated, however, that especially in a suitable arrangement of the bypass conducive to flow, satisfactory results can be achieved when only the bypass pipe can be closed off by the actuator. In other words, the bypass pipe is closed off to achieve a throughflow of the cooling pipes and thus cooling of the exhaust gas. When the bypass pipe is opened, most of the exhaust gas flows through the bypass pipe whilst a relatively small proportion of the exhaust gas continues to flow through the cooling pipes. Measurements have shown that in this arrangement the exhaust gas is likewise slightly cooled, of course. For certain applications the difference between the cooling extent in this case and the extent of the cooling when the bypass pipe is closed and throughflow is only via the cooling pipes is sufficient for influencing the temperature of the recirculated exhaust gas.

As regards the actuator preferably integrated in the cooler in accordance with the invention one advantageous embodiment consists of the actuator being a flap. This flap may be either pivoted at one end such that it closes off the bypass pipe or the inflow to the cooling pipes in two different positions. As an alternative, the flap may be configured in the form of a throttle valve, pivoted in a middle portion so that, for example, only the bypass pipe is closed off when it is not a mandatory requirement to close off the cooling pipes as described above.

A single actuator solely provided for closing off the bypass pipe is sufficient especially in preferred embodiments in which the cooler comprises a sole inflow for the exhaust gas to be recirculated, and the bypass pipe, as viewed flow-technically, is incorporated in the extension of the inflow so that it constitutes the "path of least resistance" for the exhaust gas in flowing through the bypass pipe, this meaning, more particularly, that when the inflow is arranged centrally, then also the bypass pipe is arranged centrally. In other words, the bypass pipe, just like the surrounding cooling pipes, are configured to port a so-called ported plate that the exhaust gas directed into the cooler, for a relatively low flow resistance, arrives at the opening, downstream of which the bypass pipe is located so that a substantial proportion of the exhaust gas flows therethrough. Contrary to this, when cooling is desirable and the bypass pipe is closed off by the actuator, the exhaust gas arrives at the closed opening and thus flows through the parallel arrangement of the cooling pipes. The same effect can also be achieved, however, by the embodiment in which the bypass pipe is not located centrally in the cooler but at its rim, by the inflow in this case being configured inclined such that the exhaust gas flows initially inclined, substantially in the direction of the bypass pipe, into the cooler so that it constitutes the path of least resistance with the bypass pipe open in flowing therethrough. This too, makes a relatively simple actuator, merely closing off the bypass pipe, sufficient. Otherwise, in this case the cone as evident in the Figures (cf. FIGS. 3 and 4) porting the inflow of the cooler, would be configured inclined such that the desired flow in the direction of the bypass pipe, located at a rim, is assured. It is to be noted again that in accordance with a preferred embodiment the actuator is provided such that it closes off only the bypass.

The diameter of the cooler in accordance with the invention, more particularly of its shell, can be maintained relatively small, the required cooling effect being achieved when the bypass pipe is disposed substantially centrally in the housing. When this arrangement is combined with a substantially centrally inflow, the favorable flow conditions can be assured which, as described above, involve merely closing off the bypass when the exhaust gas is to be cooled, whereas if the cooler is to be bypassed and the bypass pipe is opened, the cooling pipes can remain open.

Even though the cooler in accordance with the invention is a separate component of an exhaust gas recirculating system, it is provided for in accordance with the invention that a complete exhaust gas recirculating system is provided, comprising the cooler in accordance with the invention in one of the embodiments as described above.

It is to be noted in conclusion that the invention may also be viewed as a method in which the bypass pipe is integrated in the housing, more particularly, the shell of a cooler. In this arrangement the bypass pipe is configured as a double-walled pipe and at least the bypass pipe, preferably the complete cooler is fabricated by vacuum brazing.

This permits achieving the advantage that the vacuum between the two walls of the double-walled bypass pipe is conserved by the solidified solder and that the bypass pipe can be configured thermally insulated at very little expense.

BRIEF DESCRIPTION OF THE DRAWINGS

The invention will now be detailed with reference to the example embodiments as shown in the drawings in which.

DETAILED DESCRIPTION OF PREFERRED EMBODIMENTS OF THE INVENTION

Figure 1:
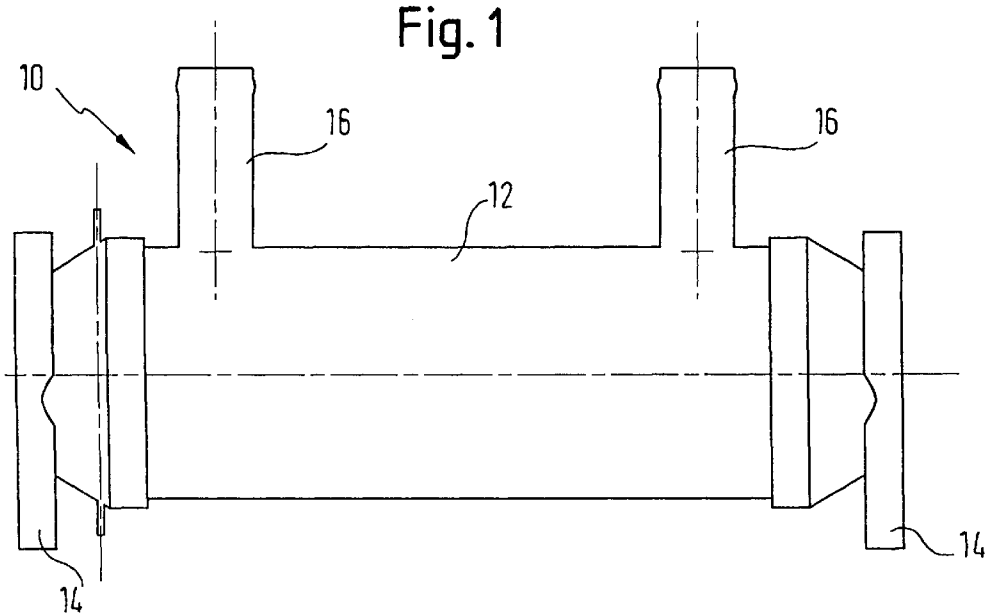
FIG. 1 is a side view of the cooler in accordance with the invention.

Referring now to FIG. 1 there is firstly illustrated the cooler 10 in accordance with the invention shown in a side view. The cooler 10 comprises a housing 12 in the form of a shell. Provided at both ends of the housing are flanges 14 serving to connect the cooler in accordance with the invention to upstream and downstream sections of an exhaust gas recirculating system. Extending through the shell 12 are at least one bypass pipe and at least one cooling pipe, as will be detailed later. Thus, as already evident from the side view as shown in FIG. 1 no piping is located outside of the shell 12 of the cooler. Instead, especially the bypass pipe is integrated in the shell 12 of the cooler. The shell 12 of the cooler is sealed off at its ends such that coolant, for example water, can be passed through its interior via an inflow and outflow 16 respectively, the coolant flowing around all pipes extending through the shell 12, as a result of which particularly the cooling pipes and their content are cooled so that the exhaust gas flowing therethrough is cooled. The bypass pipe too experiences cooling which, however, due to measures as detailed later is significantly less extensive than when the exhaust gas flows through the cooling pipes so that the cooler can be bypassed.

Figure 2:
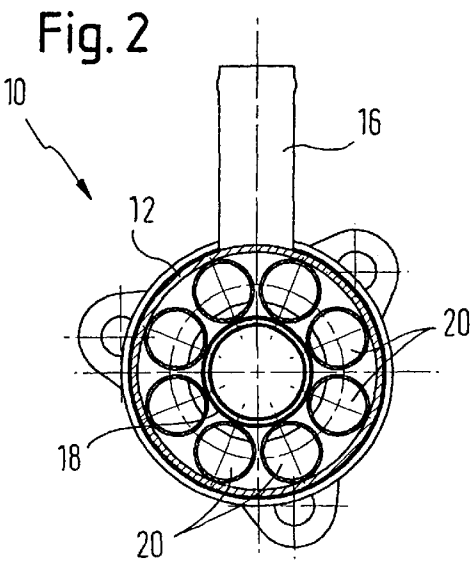
FIG. 2 is a cross-sectional view of the cooler in accordance with the invention.

Referring now to FIG. 2 there is illustrated the inner configuration of the cooler 10 and the content of its shell 12 in one first preferred embodiment. Provided substantially centrally in the shell 12 is the bypass pipe 18 which in the case as shown is provided as a double-walled pipe, a vacuum existing between the two walls. It is due to this thermal insulation, as well as due to the fact that the bypass pipe is a pipe extending substantially straight through the shell 12, that the exhaust gas in flowing through the bypass pipe 18 receives comparatively little cooling. Contrary thereto, a plurality of cooling pipes 20 are provided surrounding the bypass pipe 18 representing branchings of a preferably central cooling pipe inflow. Due to the fact that a plurality of cooling pipes 20 is provided, each having a smaller cross-section than that of the bypass pipe 18 and which, in addition, are not thermally insulated, the desired cooling effect is already achieved by the exhaust gas flowing through the cooling pipes 20. In addition, but not evident in FIG. 2, the cooling pipes can be configured coiled for their extension, as a result of which the dwell time of the exhaust gas in the cooling pipes is increased and a more intensive cooling is achievable.

Figure 3:
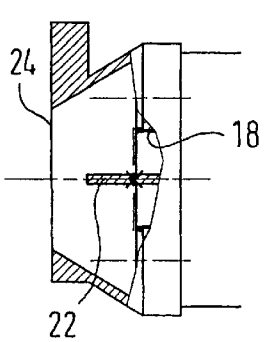
FIG. 3 is a longitudinal section view of the inflow portion of the cooler in accordance with the invention, showing an actuator in a first position.

Referring now to FIG. 3 there is illustrated how an actuator in the form of a rotary throttle valve 22 is integrated in the cooler for the inflow portion of the embodiment as shown in FIG. 1 and FIG. 2 of the cooler. Integrating the actuator 22 in the cooler means that the cooler comprises a single opening 24 through which the exhaust gas to be recirculated to the cooler is directed. In the portion of the cooler as shown in FIG. 3 the branching is configured between the substantially centrally located bypass pipe 18 and the surrounding cooling portion which is configured in the region of the shell 12 in the form of a plurality of cooling pipes 20. In accordance with the embodiment as shown the actuator 22 is provided substantially in the form of a throttle valve capable of rotating about an axis of rotation arranged in its middle portion such that the bypass pipe 18 can be opened by an alignment of the actuator 22 in the flow direction, as shown in FIG. 3. It is to be noted that in this embodiment the surrounding cooling portion as well as the cooling pipes 20 remain open even when the bypass pipe 18 is opened. However, since the bypass pipe 18 is located substantially centrally in the shell 12, the exhaust gas to be recirculated flows mainly through the bypass pipe 18 and experiences extent little cooling. The temperature of relatively small amount of exhaust gas flowing through the cooling pipes is thereby reduced to a slight extent so that no appreciable cooling occurs as is desired by opening the bypass in thus bypassing the cooler.

Figure 4:
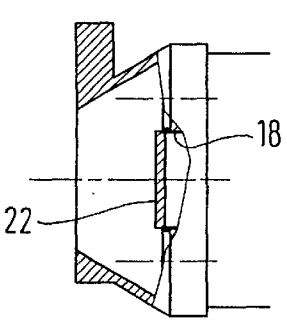
FIG. 4 is a longitudinal section view of the inflow portion of the cooler in accordance with the invention, showing an actuator in a second position.

Referring now to FIG. 4 there is illustrated the actuator 22 in the closed position in which the actuator 22 closes the bypass pipe 18. In this position the entirety of the exhaust gas flows through the cooling pipes 20 in achieving the desirable cooling of the recirculated exhaust gas. It is to be noted that the throughflow of the bypass and thus reducing the temperature of the recirculated exhaust gas is achievable by any positioning the shell 12 between the positions as shown in FIG. 3 and FIG. 4.

Figure 5:
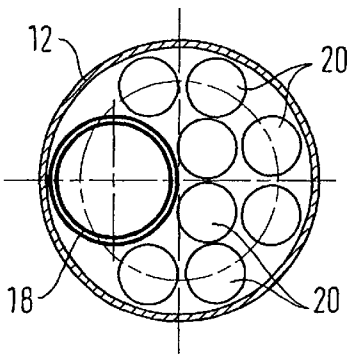
FIG. 5 is a cross-sectional view of a second embodiment of the cooler in accordance with the invention.

Referring now to FIG. 5 there is illustrated a cross-sectional view of an alternative embodiment of the cooler in accordance with the invention. In this case the bypass pipe 18 is not located centrally in the shell 12, but at its rim. The remaining portion of the shell 12 is taken up by cooling pipes 20. The effect is substantially the same as that already described in the previous embodiment, except that the inflow portion is to be configured different.

Figure 6:
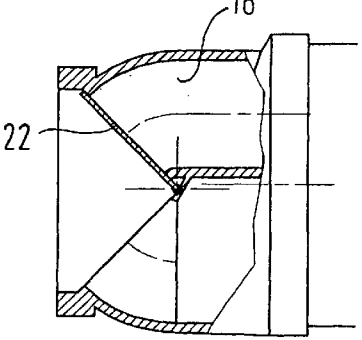
FIG. 6 is a longitudinal section view of the inflow portion of the second embodiment of the cooler in accordance with the invention.

Referring now to FIG. 6 there is illustrated how this is achieved in making it clear that the embodiment as shown in FIG. 5 is particularly suitable for a modification of the actuator by means of which either the bypass pipe 18 or the cooling pipes 20 are to be closed off. In other words, unlike the embodiment as shown in FIG. 3 and FIG. 4 the cooling pipes 20 are closed off when the bypass pipe 18 is open. In accordance with the embodiment as shown in. FIG. 6 this is achieved by a flap, the end of which is located pivoted in a portion between the bypass pipe 18 and a common inflow portion for the cooling pipes 20. In the position as shown in FIG. 6 the bypass pipe 18 is closed off. In the alternative position when the actuator 22 is pivoted down, the complete inflow portion for the cooling pipes is closed off. In conclusion it is to be noted that the embodiment of a actuator 22 as shown in FIG. 6 may also be combined with a cooler cross-section as shown in FIG. 2, the bypass pipe 18 at the starting section of the cooler, i.e. substantially the part as shown in FIG. 6, being configured curved to such an extent that it extends to the middle of the shell 12 and thus extends in the furthermore run of the shell 12 approximately centrally therethrough.

What is claimed is:

1. A cooler of an exhaust gas recirculating system comprising a housing including coolant inflow and outflow ports for cooling fluid, at least one bypass pipe for hot exhaust gas, wherein said bypass pipe is arranged within said housing, said bypass pipe is a double-walled pipe, and a vacuum is formed between both walls of said double-walled pipe to minimize cooling of the hot bypass exhaust gas flowing through the bypass pipe.

2. The cooler as set forth in claim 1, wherein said bypass pipe is arranged substantially centrally in said housing.

3. A cooler of an exhaust gas recirculating system comprising a housing including coolant inflow and outflow ports for cooling fluid, at least one bypass pipe for hot exhaust gas, said bypass pipe being arranged within said housing, wherein said cooler comprises a sole inflow and/or outflow for said exhaust to be recirculated as well as an actuator for closing off at least said bypass pipe, said bypass pipe is a double-walled pipe, and a vacuum is formed between both walls of said double-walled pipe to minimize cooling of the hot bypass exhaust gas flowing through the bypass pipe.

4. The cooler as set forth in claim 3, wherein said actuator is a flap.

5. The cooler as set forth in claim 3, wherein said bypass pipe is arranged substantially centrally in said housing.

6. A cooler of an exhaust gas recirculating system comprising a housing including coolant inflow and outflow ports for cooling fluid, at least one bypass pipe for hot exhaust gas, said bypass pipe being arranged within said housing, wherein said cooler comprises a sole inflow for said exhaust gas to be recirculated and said bypass pipe as viewed flow-technically is located in the extension of said inflow, said bypass pipe is a double-walled pipe, and a vacuum is formed between both walls of said double-walled pipe to minimize cooling of the hot exhaust gas flowing through the bypass pipe.

7. The cooler as set forth in claim 6, wherein said cooler further comprises an actuator for closing off at least said bypass pipe.

8. The cooler as set forth in claim 6, wherein said bypass pipe is arranged substantially centrally in said housing.

* * * * *